US010821443B2

(12) United States Patent
Xu et al.

(10) Patent No.: US 10,821,443 B2
(45) Date of Patent: Nov. 3, 2020

(54) LIQUID STORAGE AND RELEASE ASSEMBLY AND LIQUID STORAGE AND RELEASE CHIP

(71) Applicants: CAPITALBIO EHEALTH SCIENCE & TECHNOLOGY (BEIJING) CO., LTD., Changping District, Beijing (CN); CHONGQING EHEALTH JIUYETANG BIOLOGICAL TECHNOLOGY CO., LTD., Beibei District, Chongqing (CN); TSINGHUA UNIVERSITY, Haidian District, Beijing (CN)

(72) Inventors: Youchun Xu, Beijing (CN); Haoying Shao, Beijing (CN); Cheng Chen, Beijing (CN); Liangbin Pan, Beijing (CN)

(73) Assignees: CAPITALBIO EHEALTH SCIENCE & TECHNOLOGY (BEIJING) CO., LTD., Beijing (CN); CHONGQING EHEALTH JIUYETANG BIOLOGICAL TECHNOLOGY CO., LTD., Chongqing (CN); TSINGHUA UNIVERSITY, Beijing (CN)

( * ) Notice: Subject to any disclaimer, the term of this patent is extended or adjusted under 35 U.S.C. 154(b) by 427 days.

(21) Appl. No.: 15/686,070

(22) Filed: Aug. 24, 2017

(65) Prior Publication Data

US 2018/0056295 A1 Mar. 1, 2018

(30) Foreign Application Priority Data

Aug. 30, 2016 (CN) ..... 2016 1 0786207

(51) Int. Cl.
*B01L 3/00* (2006.01)

(52) U.S. Cl.
CPC ..... *B01L 3/52* (2013.01); *B01L 2200/025* (2013.01); *B01L 2200/16* (2013.01);
(Continued)

(58) Field of Classification Search
CPC .. B01L 3/52; B01L 2200/025; B01L 2200/16; B01L 2300/0803;
(Continued)

(56) References Cited

U.S. PATENT DOCUMENTS

2006/0275852 A1* 12/2006 Montagu ..... G01N 33/54366 435/7.93
2010/0297659 A1* 11/2010 Yoo ..... G01N 35/00029 435/6.16
(Continued)

FOREIGN PATENT DOCUMENTS

CN 101971035 A 2/2011
CN 204261687 * 4/2015
(Continued)

OTHER PUBLICATIONS

Japanese Office Action for Application No. 2017-150029, dated Aug. 28, 2018 in 4 pages (English summary included).

*Primary Examiner* — Benjamin R Whatley
*Assistant Examiner* — Jacqueline Brazin
(74) *Attorney, Agent, or Firm* — Knobbe, Martens, Olson & Bear, LLP

(57) ABSTRACT

A liquid storage and release chip provided according to the present application includes a structural layer and an elastic cover sheet. An end surface of one side of the structural layer is provided with a liquid storage cell and a liquid quantitation cell, the liquid storage cell and the liquid quantitation cell are separated by a common partition wall, and the partition wall is provided with a valve opening passing through end surfaces of two sides of the structural layer. The
(Continued)

elastic cover sheet is attached to the structural layer and covers the liquid storage cell, the liquid quantitation cell and the valve opening in a sealed manner, and the valve opening allows a spool to be inserted in the valve opening in a sealed manner to push up a portion, covering the valve opening, of the elastic cover sheet.

19 Claims, 8 Drawing Sheets

(52) U.S. Cl.
CPC ..... *B01L 2300/0803* (2013.01); *B01L 2300/0887* (2013.01); *B01L 2300/123* (2013.01); *B01L 2400/0409* (2013.01); *B01L 2400/0633* (2013.01); *B01L 2400/0655* (2013.01)

(58) Field of Classification Search
CPC ..... B01L 2300/0887; B01L 2300/123; B01L 2400/0409; B01L 2400/0633; B01L 2400/0655
USPC ..... 422/521
See application file for complete search history.

(56) References Cited

U.S. PATENT DOCUMENTS

| | | | | |
|---|---|---|---|---|
| 2011/0014606 | A1* | 1/2011 | Steinmetzer | B01J 19/0046 435/6.11 |
| 2012/0247577 | A1 | 10/2012 | Nakao et al. | |
| 2014/0186214 | A1* | 7/2014 | Momose | B01L 3/502753 422/68.1 |
| 2014/0186846 | A1 | 7/2014 | Tanaka et al. | |
| 2017/0080422 | A1* | 3/2017 | Maaskant | B01D 17/0217 |
| 2017/0182493 | A1* | 6/2017 | Perroud | B01L 3/502715 |

FOREIGN PATENT DOCUMENTS

| | | | |
|---|---|---|---|
| CN | 204261687 | U | 4/2015 |
| CN | 105203746 | U | 12/2015 |
| CN | 205361370 | U | 7/2016 |
| JP | 2007263707 | A | 10/2007 |
| JP | 2010032446 | A | 2/2010 |
| WO | 2013/157667 | A1 | 10/2013 |

* cited by examiner

LIQUID STORAGE AND RELEASE ASSEMBLY AND LIQUID STORAGE AND RELEASE CHIP

CROSS-REFERENCE TO RELATED APPLICATIONS

This application claims the benefit of priority to Chinese Patent Application No. 201610786207.5 titled "LIQUID STORAGE AND RELEASE ASSEMBLY AND LIQUID STORAGE AND RELEASE CHIP" and filed with the Chinese State Intellectual Property Office on Aug. 30, 2016, the entire disclosure of which is incorporated herein by reference.

FIELD

The present application relates to the field of analysis and detection techniques, and particularly to a liquid storage and release chip, and further to a liquid storage and release assembly including the liquid storage and release chip.

BACKGROUND

The vast majority of biochemical reactions require the participation of liquids, and liquids, especially water, can provide a stable and dynamic reaction environment for biomolecules. Therefore, the addition of a liquid reagent is involved in the process of most biochemical reactions, such as the reactions for biochemical analysis, immunoassay, nucleic acid extraction, protein extraction, nucleic acid amplification and so on.

In the field of point-of-care testing (POCT), storing reagents in a reaction device and automatically realizing the release and addition of the reagents is one of the key technologies, and is also a prerequisite for achieving the automation, portability and user friendliness of the detection device. In the existing studies, ampoules are common devices for liquid storage, an ampoule is generally placed in a chip or a reaction device, and before use, it is hit by an external mechanical structure to be broken, to release the liquid contained therein. In this method, though the stability of liquid storage is good, the processing of the ampoules is troublesome, and the ampoule is hard to be made small, thus finally adversely affecting the dimension of the chip or the reaction device. In addition, this method requires a specialized motion mechanism to hit the ampoule, and the broken glass pieces may pierce through a structural layer of the chip or block structures such as a pipeline. In the conventional technology, a bladder is also commonly used for reagent storage, for example, an i-STAT blood-gas analyzer just employs the bladder to store some reagents for participation with reactions, and in use, the bladder is squeezed by an external pressure to allow it to come into contact with a barb to be punctured by the barb to release the liquid. Although this method will not produce broken glass pieces like the method using ampoules, the bladder is also hard to be made very small, and requires to be squeezed by a specialized puncturing mechanism and an external force. In order to avoid the use of a motion mechanism for releasing the liquid, the researchers proposed a method which uses laser irradiation to burn through a film for separating an upper pipeline and a lower pipeline, to release liquid. This method uses a solid-state laser to perform the liquid release, avoids the use of the motion mechanism, however, the chip requires a multi-layer structure, and the high temperature generated in laser cauterization may have an adverse effect on the liquid. In addition, the cost and volume of the laser is also a big problem. A research team at the University of Freiburg in Germany proposed a method that employs an aluminum foil sealed bladder and drives the liquid to break through a bonding portion of the bladder by a high-speed centrifugation to thereby releasing the liquid. However, like other bladders, the aluminum foil bladder has a relatively flat shape and occupies a large area or volume of a chip or a reaction device. In addition, the production of the aluminum foil bladder requires specific materials and processes, and opening the bladder requires a large centrifugal force, which imposes a high requirement on the rotation speed of the motor of the device.

Accordingly, the conventional techniques for liquid storage and release involve a complex structure, a high cost, a large dimension, and a poor reliability of liquid storage and release.

SUMMARY

In view of this, an object of the present application is to provide a liquid storage and release chip to simplify the structure and operation, reduce the cost and the size, and improve the reliability of liquid storage and release.

Another object of the present application is to provide a liquid storage and release assembly including the liquid storage and release chip, to simplify the structure and operation for liquid storage and release and to improve the reliability of liquid storage and release.

In order to achieve the above objects, the following technical solutions are provided according to the present application.

A liquid storage and release chip includes a structural layer, wherein an end surface of one side of the structural layer is provided with a liquid storage cell and a liquid quantitation cell, the liquid storage cell and the liquid quantitation cell are separated by a common partition wall, and the partition wall is provided with a valve opening passing through end surfaces of two sides of the structural layer; and an elastic cover sheet attached to the structural layer and covering the liquid storage cell, the liquid quantitation cell and the valve opening in a sealed manner, wherein the valve opening is configured to allow a valve column to be inserted in the valve opening in a sealed manner to push up a portion, covering the valve opening, of the elastic cover sheet.

Preferably, in the liquid storage and release chip described above, the structural layer is further provided with a centrifugal positioning hole, and the liquid storage cell is located between the liquid quantitation cell and the centrifugal positioning hole.

Preferably, in the liquid storage and release chip described above, a surface, attached to the elastic cover sheet, of the partition wall is provided with a through groove, and the through groove is configured to allow the liquid storage cell, the liquid quantitation cell and the valve opening to be in communication with each other, and the elastic cover sheet is elastically attached to a surface of the through groove.

Preferably, in the liquid storage and release chip described above, the through groove has an arc-shaped cross section.

Preferably, the liquid storage and release chip described above further includes a plunger filled in the valve opening in a sealed manner, and the plunger has a length less than a length of the valve opening.

Preferably, the liquid storage and release chip described above further includes a second elastic cover sheet, the second elastic cover sheet is attached to an end surface of a side, away from the elastic cover sheet, of the structural layer, and the second elastic cover sheet covers the valve opening.

Preferably, in the liquid storage and release chip described above, a material of the second elastic cover sheet is silica gel, latex or polyurethane.

Preferably, in the liquid storage and release chip described above, a section, at an end toward the elastic cover sheet, of the valve opening is smaller than a section, at an end toward the second elastic cover sheet, of the valve opening.

Preferably, in the liquid storage and release chip described above, an end surface of a side, away from the elastic cover sheet, of the structural layer is further provided with a sample inlet in communication with the liquid storage cell.

Preferably, in the liquid storage and release chip described above, the structural layer and/or the elastic cover sheet is a transparent layer.

Preferably, in the liquid storage and release chip described above, a material of the structural layer is any one or any combination of a high molecular polymer material, glass or metal.

Preferably, in the liquid storage and release chip described above, the elastic cover sheet is an elastic layer made of a high molecular polymer material, or an elastic film structure made of a metal film, and the elastic cover sheet has a thickness ranging from 0.01 mm to 2 mm.

Preferably, in the liquid storage and release chip described above, the elastic cover sheet is a single-sided adhesive tape.

A liquid storage and release assembly is further provided according to the present application, which includes a tray and the liquid storage and release chip according to any one of the above aspects. The tray is provided with a valve column, and the valve column is configured to be inserted into the valve opening of the liquid storage and release chip in a sealed manner, and to push up the elastic cover sheet of the liquid storage and release chip at a position of the valve opening, to form a circulation gap.

Compared with the conventional technology, the present application has the following beneficial effects.

The liquid storage and release chip according to the present application includes a structural layer and an elastic cover sheet. An end surface of one side of the structural layer is provided with a liquid storage cell and a liquid quantitation cell, the liquid storage cell and the liquid quantitation cell are separated by a common partition wall. The partition wall is provided with a valve opening passing through end surfaces of two sides of the structural layer. The elastic cover sheet is attached to the structural layer and covers the liquid storage cell, the liquid quantitation cell and one end of the valve opening in a sealed manner. A valve column can be inserted into another end of the valve opening, and the valve column is configured to push up a portion, covering on the valve opening, of the elastic cover sheet. The liquid is stored in the liquid storage cell, and since the liquid storage cell and the liquid quantitation cell are separated by the partition wall, and the elastic cover sheet is covered on the liquid storage cell, the liquid quantitation cell and the valve opening, the liquid storage cell and the liquid quantitation cell are not in communication with each other at this time, and the liquid can be stored in the liquid storage cell in a sealed manner. When the liquid is required to be released, the valve column is inserted into the valve opening in a sealed manner, and the valve column pushes up the portion, covered on the valve opening, of the elastic cover sheet, to form a circulation gap between the elastic cover sheet and the valve opening, thereby communicating the liquid storage cell with the liquid quantitation cell. A centrifugal operation is performed on the liquid storage and release chip in a centrifugal direction from the liquid storage cell to the liquid quantitation cell to allow the liquid in the liquid storage cell to be driven by the centrifugal force to enter the liquid quantitation cell through the circulation gap, thereby realizing the liquid release. It can be seen that liquid is directly stored in the liquid storage cell of the chip, thus, when releasing the liquid, it simply requires to use the valve column to push up the elastic cover sheet and perform a general centrifugal operation, the liquid may just be released into the liquid quantitation cell of the chip, the structure is simple, the operation is convenient and reliable without causing adverse effects to the liquid, the chip has a low cost, and may have a reduced size and volume and facilitates the integration and portable operation.

The liquid storage and release assembly according to the present application includes a tray and a liquid storage and release chip, and when releasing the liquid, a valve column of the tray is inserted into a valve opening of the liquid storage and release chip to push up the elastic cover sheet to form a circulation gap, and under a centrifugal action, the release of liquid from the liquid storage cell to the liquid quantitation cell is achieved, thereby simplifying the structure and operation for the liquid storage and release and improving the reliability of the liquid storage and release.

BRIEF DESCRIPTION OF THE DRAWINGS

For more clearly illustrating embodiments of the present application or the technical solutions in the conventional technology, drawings referred to describe the embodiments or the conventional technology will be briefly described hereinafter. Apparently, the drawings in the following description are only some examples of the present application, and for the person skilled in the art, other drawings may be obtained based on these drawings without any creative efforts.

REFERENCE NUMERALS IN FIGS. 1 TO 16

Figure 1:
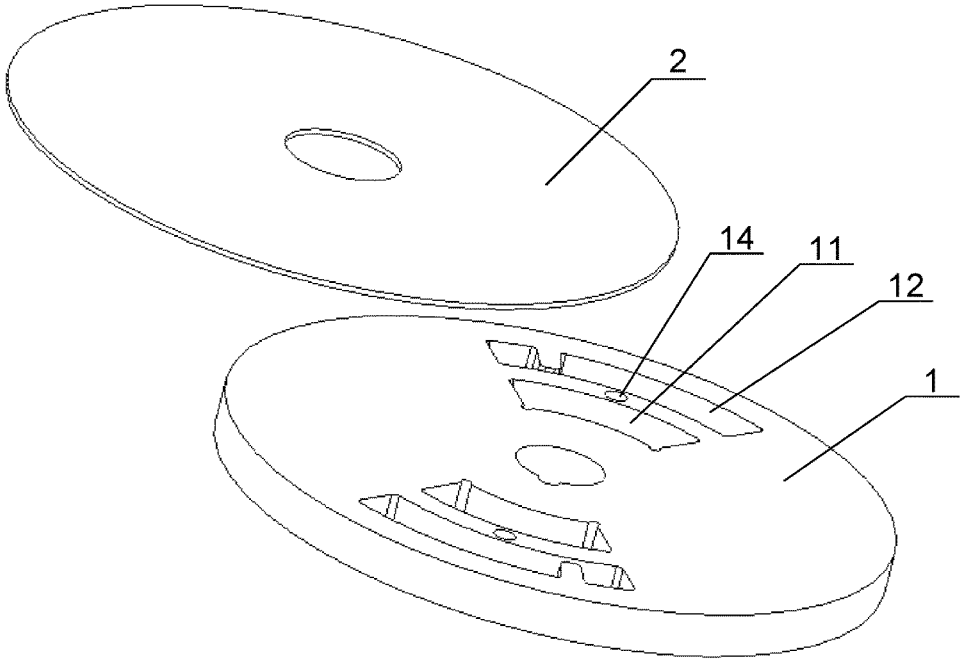
FIG. 1 is a schematic exploded view of a liquid storage and release chip according to an embodiment of the present application.
Figure 2:
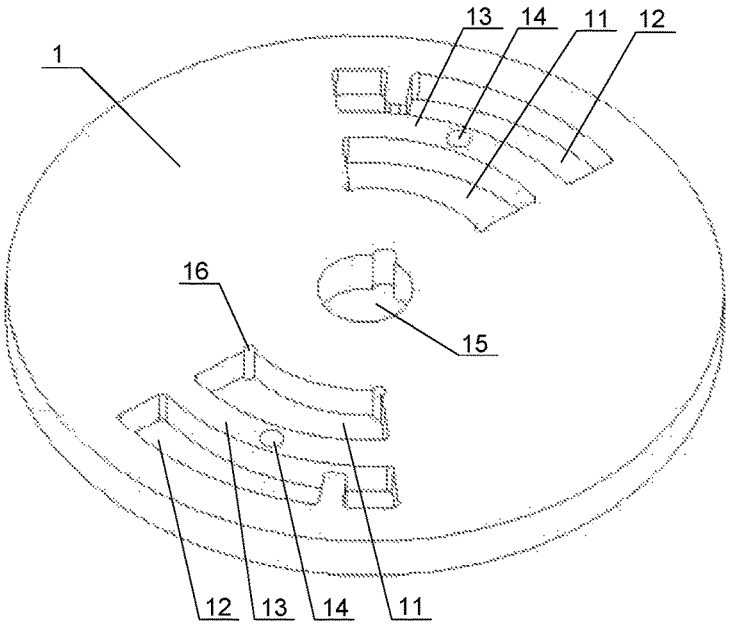
FIG. 2 is a schematic view showing the structure of a top side of a structural layer of a liquid storage and release chip according to an embodiment of the present application.
Figure 3:
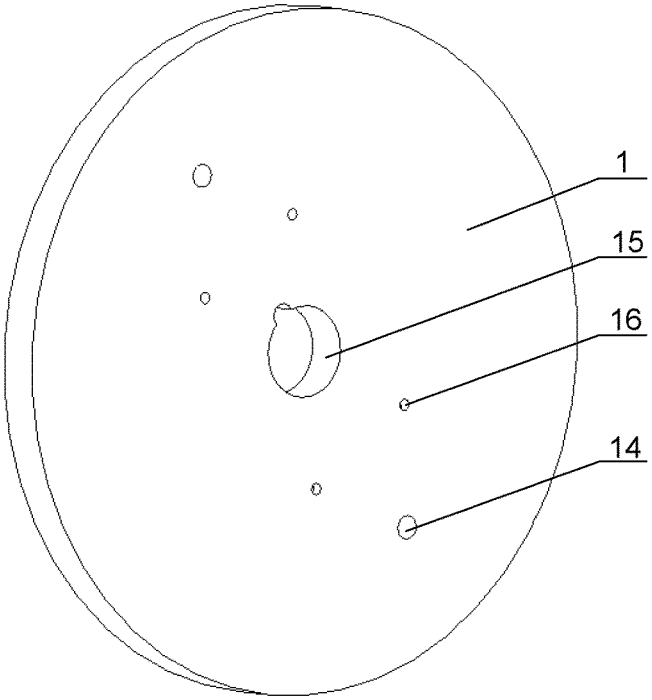
FIG. 3 is a schematic view showing the structure of a bottom side of the structural layer of the liquid storage and release chip according to an embodiment of the present application.
Figure 4:
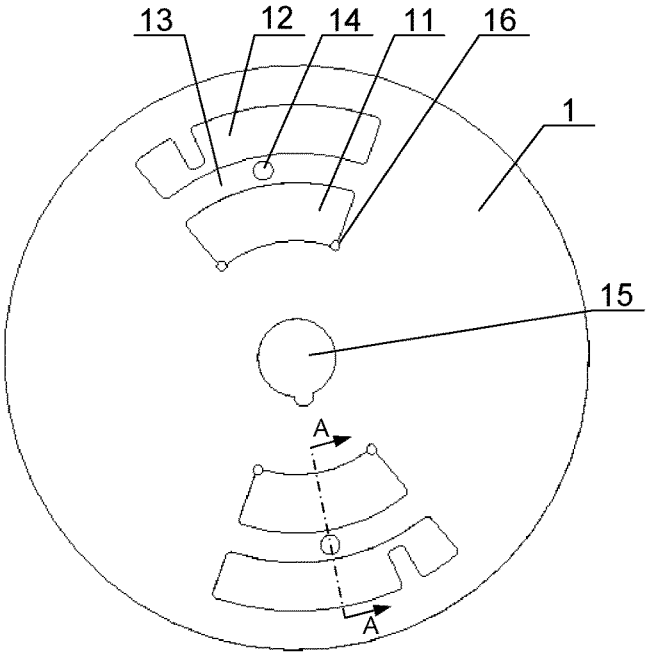
FIG. 4 is a top view of the structural layer of the liquid storage and release chip according to an embodiment of the present application.
Figure 5:
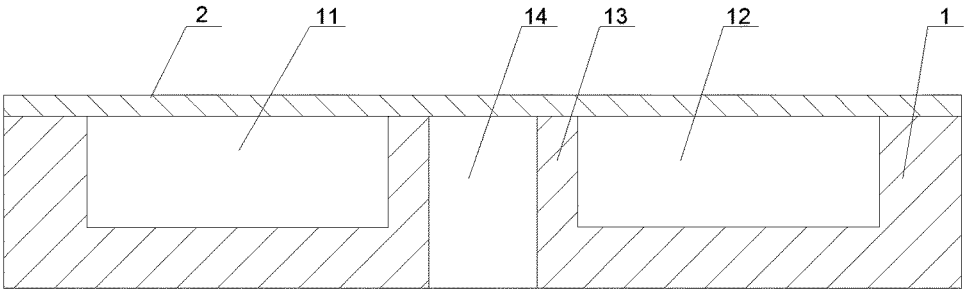
FIG. 5 is a schematic sectional view taken along the line A-A in FIG. 4.
Figure 6:
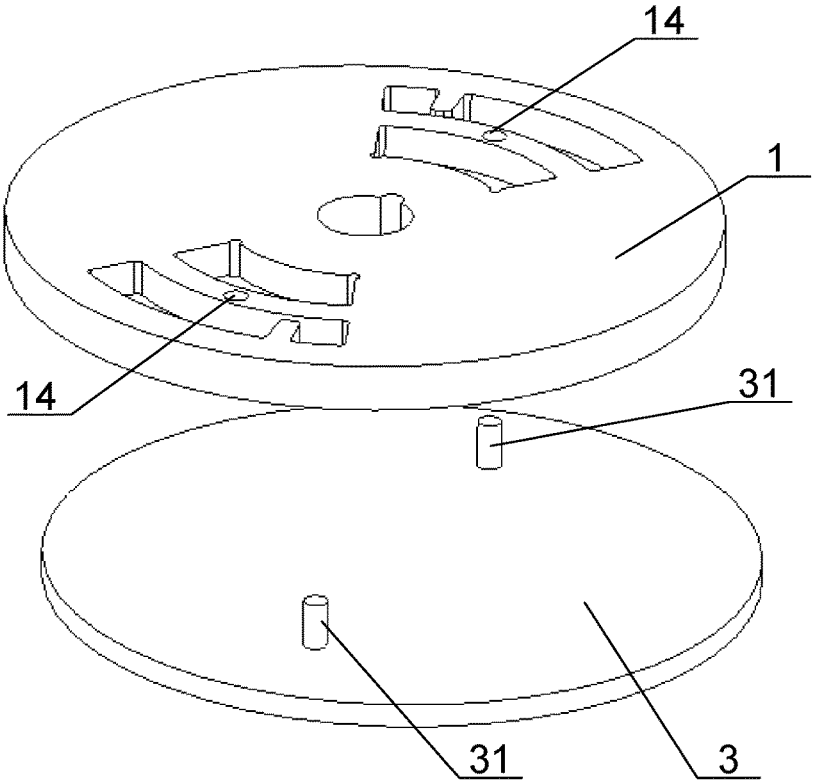
FIG. 6 is a schematic view showing the structure of the liquid storage and release chip according to the embodiment of the present application and a tray before being assembled.
Figure 7:
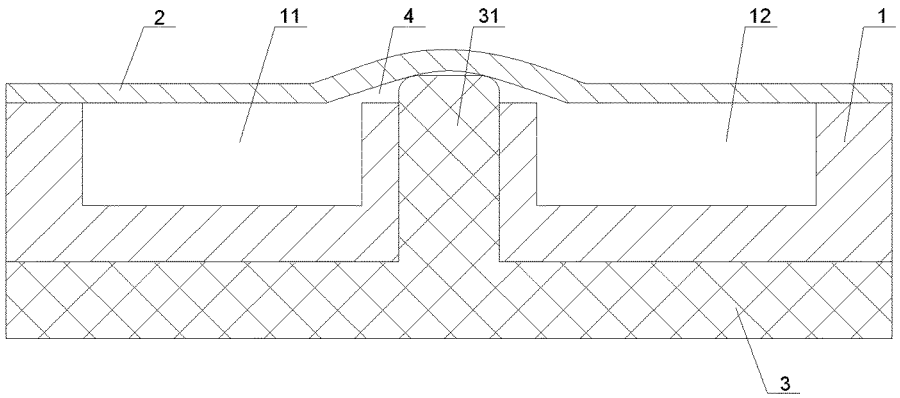
FIG. 7 is a schematic partial sectional view of the liquid storage and release chip according to the embodiment of the present application and the tray after being assembled.
Figure 8:
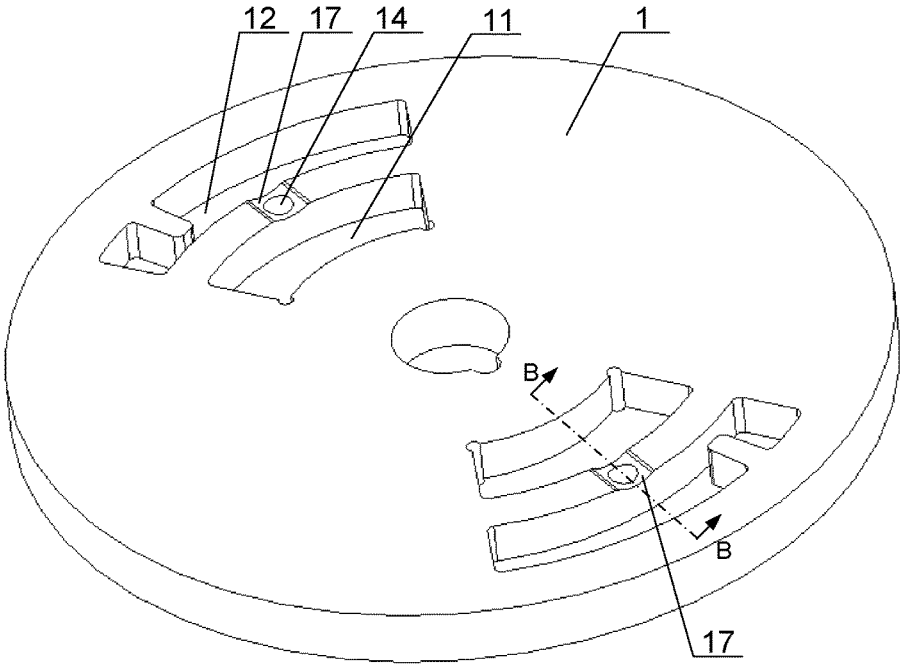
FIG. 8 is a schematic view showing the structure of a structure layer of a second type of the liquid storage and release chip according to an embodiment of the present application.
Figure 9:
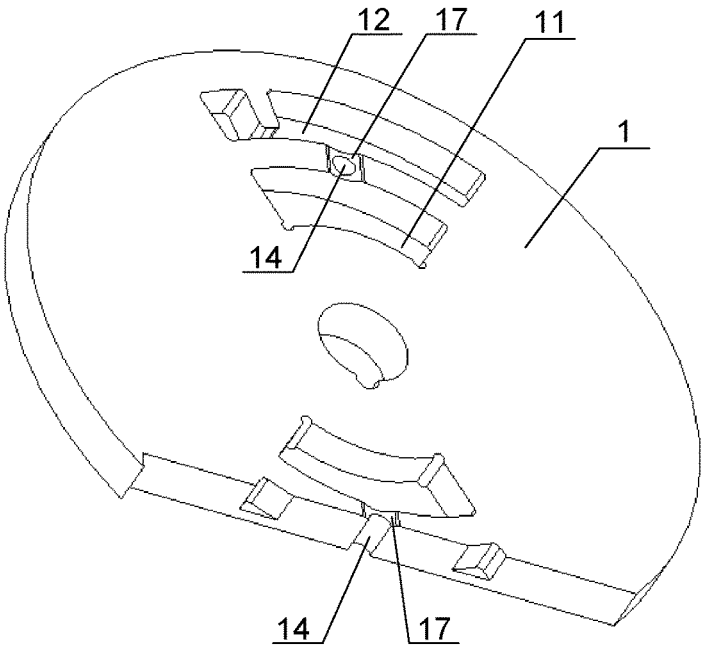
FIG. 9 is a schematic view showing the structure of a section of FIG. 8.
Figure 10:
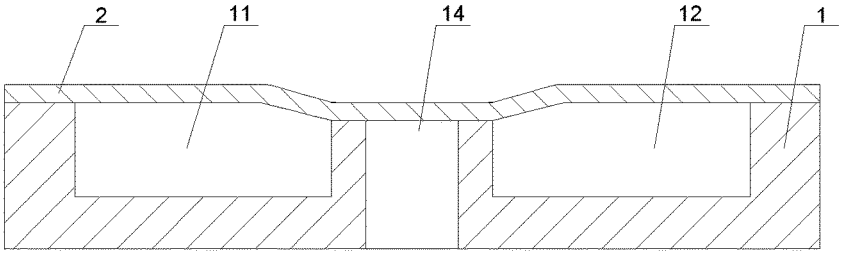
FIG. 10 is a schematic sectional view taken along the line B-B in FIG. 8.
Figure 11:
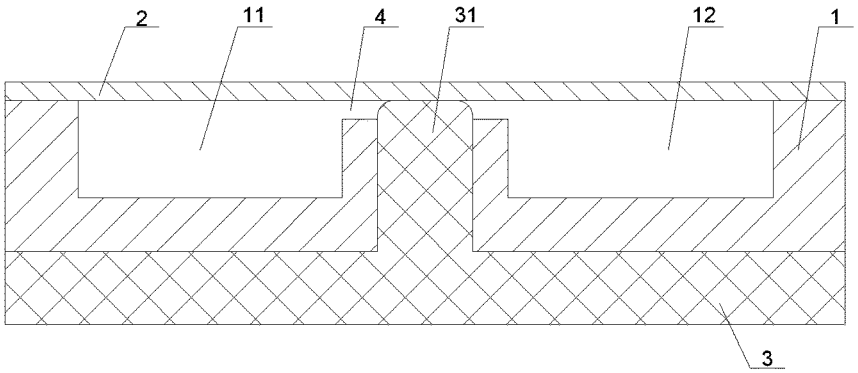
FIG. 11 is a schematic partial sectional view of the liquid storage and release chip in FIG. 8 and a tray after being assembled taken along a direction B-B.
Figure 12:
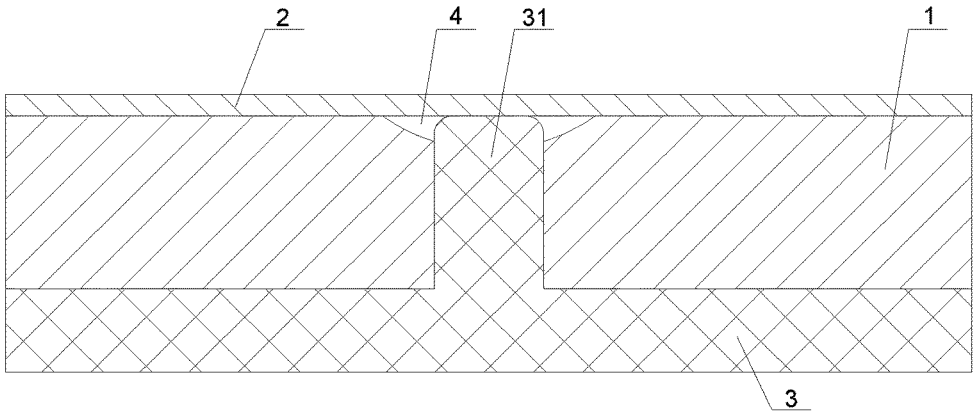
FIG. 12 is a schematic partial sectional view of the liquid storage and release chip in FIG. 8 and the tray after being assembled taken alone a direction perpendicular to the B-B direction.

1 structural layer, 11 liquid storage cell,
12 liquid quantitation cell, 13 partition wall,
14 valve opening, 15 centrifugal positioning hole,
16 sample inlet, 17 through slot,
2 elastic cover sheet, 3 tray,
31 valve column, 4 circulation gap,
5 plunger, and 6 second elastic cover sheet.

DETAILED DESCRIPTION

A liquid storage and release chip is provided according to the present application, which simplifies the structure and operation, reduces costs, reduces the size, and improves the reliability of liquid storage and release.

A liquid storage and release assembly including the liquid storage and release chip is further provided according to the present application, which simplifies the structure and operation for liquid storage and release, and improves the reliability of liquid storage and release.

The technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the scope of protection of the present application.

Referring to FIGS. 1 to 7, a liquid storage and release chip, hereinafter abbreviated as a chip, is provided according to an embodiment of the present application. The chip includes a structural layer 1 and an elastic cover sheet 2. An end surface of one side of the structural layer 1 is provided with at least one liquid storage cell 11 and at least one liquid quantitation cell 12, and the liquid storage cell 11 and the liquid quantitation cell 12 are separated by a common partition wall 13. The partition wall 13 is provided with a valve opening 14 passing through end surfaces of two sides of the structural layer 1. The valve opening 14 has one end located in a top surface of the partition wall 13 and another end located in a bottom surface of the structural layer 1. The elastic cover sheet 2 is attached to the top surface of the structural layer 1 and covers and seals the liquid storage cell 11, the liquid quantitation cell 12 and the valve opening 14. A valve column 31 may be inserted into the valve opening 14 in a sealed manner, and the valve column 31 is configured to push up a portion, covered on the valve opening 14, of the elastic cover sheet 2. An outer peripheral surface of the valve column 31 is cooperated with an inner peripheral surface of the valve opening 14 in a sealed manner.

The operation principle of the above liquid storage and release chip is described as follows. A liquid is stored in the liquid storage cell 11, and since the liquid storage cell 11 and the liquid quantitation cell 12 are separated by the partition wall 13, and the elastic cover sheet 2 is covered on the liquid storage cell 11, the liquid quantitation cell 12 and the valve opening 14, the liquid storage cell 11 and the liquid quantitation cell 12 are not in communication with each other at this time, and the liquid can be stored in the liquid storage cell 11 in a sealed manner. When the liquid is required to be released, the valve column 31 is inserted into the valve opening 14 in a sealed manner, and the valve column 31 pushes up the portion, covered on the valve opening 14, of the elastic cover sheet 2, and since the elastic cover sheet 2 has elasticity, a circulation gap 4 is only formed between the elastic cover sheet 2 and the valve opening 14, that is, the elastic cover sheet 2 and the top surface of the partition wall 13 form the circulation gap 4 only at the position corresponding to the valve opening 14, thereby communicating the liquid storage cell 11 with the liquid quantitation cell 12. A centrifugal operation is performed on the liquid storage and release chip in a centrifugal direction from the liquid storage cell 11 to the liquid quantitation cell 12, to allow the liquid in the liquid storage cell 11 to be driven by a centrifugal force to enter the liquid quantitation cell 12 through the circulation gap 4, thereby realizing the liquid release. It can be seen that the liquid storage cell 11 and the liquid quantitation cell 12 are cavities integrally formed in the chip, and the liquid is directly stored in the liquid storage cell 11 of the chip, thus, when releasing the liquid, it simply requires to use the valve column 31 to push up the elastic cover sheet 2 and employ a general centrifugal operation, the liquid can be released into the liquid quantitation cell 12 of the chip, thus the structure is simple, the operation is convenient and reliable, the issues such as large volume and inconvenient manufacturing caused by the use of ampoules or bladders can be avoided, the size and volume of the chip are reduced, and it does not require to break the ampoules or the bladders and does not require additional operation and motion mechanism, and will not cause adverse effects on the liquid, and thus the cost is reduced, and the integration and portable operation is facilitated.

As shown in FIGS. 1 to 4, in this embodiment, the structural layer 1 is further provided with a centrifugal positioning hole 15, and the liquid storage cell 11 is located between the liquid quantitation cell 12 and the centrifugal positioning hole 15. The centrifugal positioning hole 15 is configured to circumferentially fix the position of the chip with respect to a centrifugal shaft of a centrifugal device, to allow the chip to be driven by the centrifugal shaft to rotate. Since the liquid storage cell 11 is located between the liquid quantitation cell 12 and the centrifugal positioning hole 15, the centrifugal direction is directed from the liquid storage cell 11 to the liquid quantitation cell 12. The centrifugal positioning hole 15 may be a through hole extending through the end surfaces of the two sides of the structural layer 1 or a blind hole arranged in the bottom surface of the structural layer 1. If the centrifugal positioning hole 15 is the through hole, the elastic cover sheet 2 is also provided with a positioning hole at a position corresponding to the centrifugal positioning hole 15. If the centrifugal positioning hole 15 is the blind hole, it is not required to arrange a positioning hole in the elastic cover sheet 2, as long as the positioning of the centrifugal positioning hole 15 with respect to the centrifugal shaft can be achieved. In the case that multiple liquid storage cells 11 and multiple liquid quantitation cells 12 are provided on the structural layer 1, each pair of the liquid storage cell 11 and the liquid quantitation cell 12 constitute one group, and each group of the liquid storage cells 11 and the liquid quantitation cells 12 are distributed uniformly around the centrifugal positioning hole 15 in the circumferential direction, and a symmetrical layout structure of two groups of the liquid storage cells 11 and the liquid quantitation cells 12 is illustrated in the Figure.

Of course, the centrifugal operation of the chip can be implemented in other forms. Instead of providing the centrifugal positioning hole 15, an outer periphery of the chip can be clamped by the centrifugal device, and the centrifugal operation can be performed as well.

As shown in FIGS. 8 to 12, in this embodiment, a surface, attached to the elastic cover sheet 2, of the partition wall 13 is provided with a through groove 17 configured to allow the liquid storage cell 11, the liquid quantitation cell 12 and the valve opening 14 to be in communication with each other, and the elastic cover sheet 2 is elastically attached to the surface of the through groove 17. That is, the top surface of the partition wall 13 is provided with the through groove 17 at a position where the valve opening 14 is located. When storing the liquid, the elastic cover sheet 2 is attached to the surface of the through groove 17 in a sealed manner, thus the liquid storage cell 11 is not in communication with the liquid quantitation cell 12. When it is required to release the liquid, the valve column 31 is inserted into the valve opening 14 in a sealed manner, the valve column 31 pushes up the portion of the elastic cover sheet 2 that is attached to the surface of the through groove 17 in a sealed manner, and preferably, the elastic cover sheet 2 is changed from a recessed state into a flat state, to form a circulation gap 4, thus, the liquid storage cell 11 is in communication with the liquid quantitation cell 12 through the through groove 17. Driven by the centrifugal force, the liquid enters the liquid quantitation cell 12 from the liquid storage cell 11 through the through groove 17 to perform the liquid release. Since the liquid circulates in the through groove 17, the liquid release is better guided, and the distribution of the liquid is more regular and controllable. In addition, since the portion, corresponding to the through groove 17, of the elastic cover sheet 2 is partially recessed, the valve column 31 only needs to push up this recessed portion, thus compared with the chip that is not provided with the through groove 17, the strength required by the valve column 31 to push up the partially recessed portion of the elastic cover sheet 2 is smaller, which facilitates the liquid release.

As an optimized solution, the through groove 17 has an arc-shaped cross section, and the elastic cover sheet 2 is formed with an arc-shaped recess at the position corresponding to the through groove 17, such that the elastic cover sheet 2 can be tightly attached to the surface of the through groove 17 in a sealed manner without any sealing dead corner.

Figure 13:
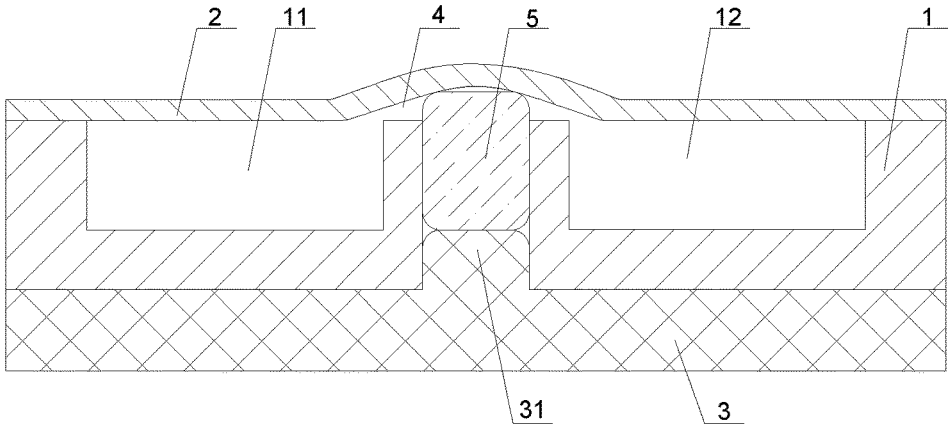
FIG. 13 is a schematic partial sectional view of a third type of the liquid storage and release chip according to an embodiment of the present application and a tray after being assembled.

As shown in FIG. 13, on the basis of the chip in any or all of the embodiments described above, a chip in this embodiment further includes a plunger 5, the plunger 5 is filled in the valve opening 14 in a sealed manner and has a length less than a length of the valve opening 14. In use, the plunger 5 is partially filled in the valve opening 14 in advance to prevent the valve column 31 from directly contacting the liquid in the chip, to avoid potential contaminations. Further, by using the plunger 5, the length of the valve column 31 extending into the valve opening 14 is sharply decreased, thus reducing the difficulty of placing the chip on the valve column 31.

Preferably, the valve column 31 is made of a resilient material, such as polytetrafluoroethylene, silica gel, polydimethylsiloxane or polypropylene, and etc. The plunger 5 should be sized to ensure that the plunger 5 can be resiliently stuck into the valve opening 14 after being plugged therein and will not fall off during use, and meanwhile to ensure that the plug 5 can slide inside the valve opening 14 and push up the elastic cover sheet 2 partially while the plug 5 is squeezed by the valve column 31.

Figure 14:
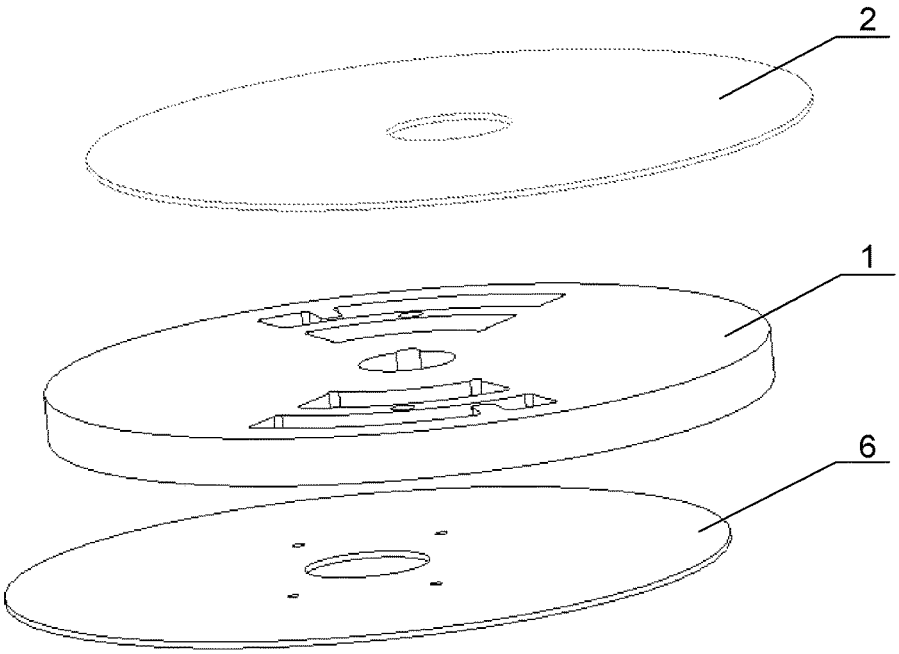
FIG. 14 is a schematic exploded view of a fourth type of the liquid storage and release chip according to an embodiment of the present application.
Figure 15:
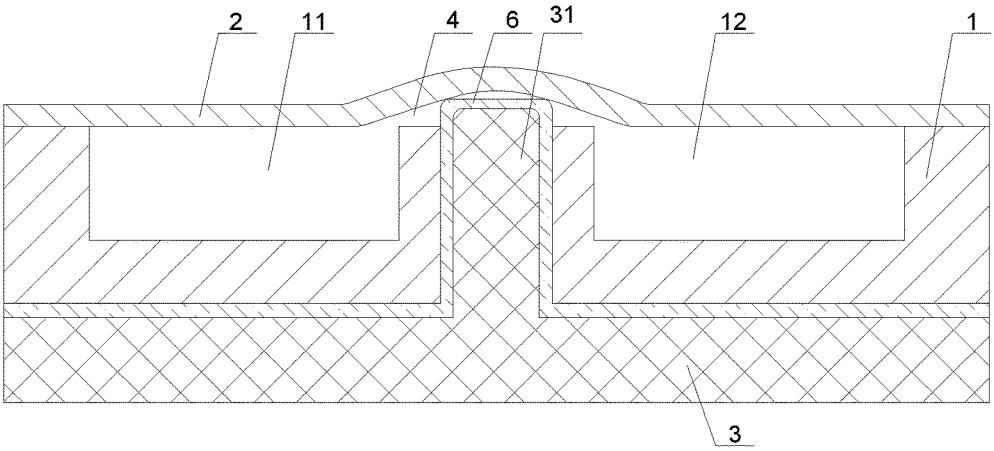
FIG. 15 is a schematic partial sectional view of the liquid storage and release chip in FIG. 14 and a tray after being assembled.

As shown in FIGS. 14 and 15, on the basis of the chip in any or all of the above embodiments, a chip in this embodiment further includes a second elastic cover sheet 6. The second elastic cover sheet 6 is attached to an end surface of a side, away from the elastic cover sheet 2, of the structural layer 1, that is, the second elastic cover sheet 6 is attached to the bottom surface of the structural layer 1. The second elastic cover sheet 6 covers the valve opening 14, and the area of the second elastic cover sheet 6 is less than or equal to that the area of the bottom surface of the structural layer 1 as long as the second elastic cover sheet 6 can cover the valve opening 14. The end, at the bottom of the structural layer 1, of the valve opening 14 is sealed by the second elastic cover sheet 6, thereby further isolating the chip from the external environment. Since the second elastic cover sheet 6 also has elasticity, the valve column 31 can be directly inserted into the valve opening 14 from the outside of the second elastic cover sheet 6, and the second elastic cover sheet 6 is elastically deformed, and enters the valve opening 14 along with the valve column 31, and as the valve column 31 is inserted further, the second elastic cover sheet 6 pushes up the portion, corresponding to the valve opening 14, of the elastic cover sheet 2, to form the circulation gap 4. In the whole process of liquid release, the second elastic cover sheet 6 always seals the valve opening 14, thus ensuring the sealing performance of the chip, and meanwhile, the valve column 31 will not come into contact with the liquid in the chip, thereby avoiding potential contaminations.

As an optimized solution, the material of the second elastic cover sheet 6 is silica gel, latex or polyurethane, and has a great elasticity to meet the large deformation requirements of the second elastic cover sheet 6. Preferably, the second elastic cover sheet 6 is partially or wholly bonded to the structural layer 1 in a sealed manner.

Figure 16:
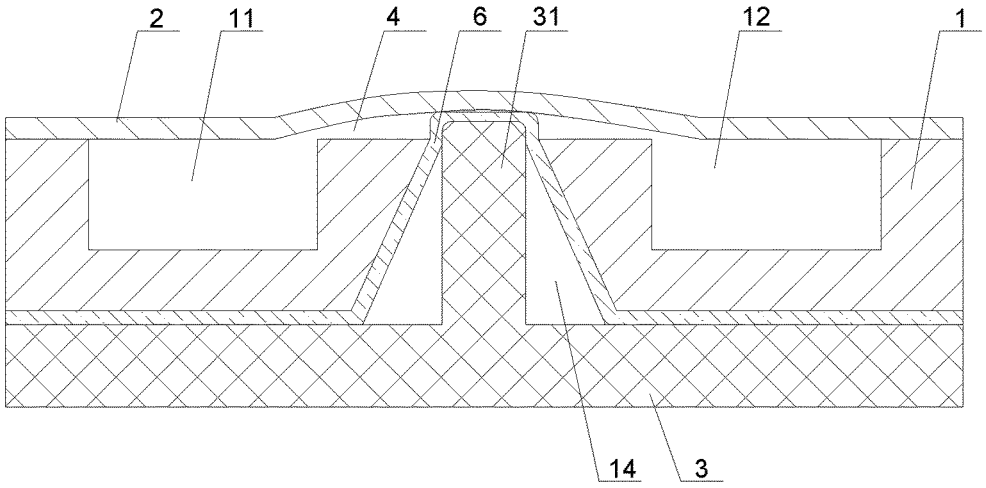
FIG. 16 is a schematic partial sectional view of a fifth type of the liquid storage and release chip according to an embodiment of the present application and a tray after being assembled.

In order to avoid the second elastic cover sheet 6 from being torn up due to an excessive partial deformation, as shown in FIG. 16, the shape of the valve opening 14 in this embodiment is optimized, to allow a section of the valve opening 14 at an end toward the elastic cover sheet 2 to be smaller than a section of the valve opening 14 at an end toward the second elastic cover sheet 6, and the valve opening 14 may be specifically configured as a conical hole, a pyramid hole or the like. When the valve column 31 is inserted into the valve opening 14, the second elastic cover sheet 6 is deformed and then fits against an inner wall of the valve opening 14, and the structure of the valve opening 14 enables the second elastic cover sheet 6 to have a smaller tension degree compared to the situation that the valve opening 14 has the same section at the two ends, thus reducing the risk of the second elastic cover sheet 6 being torn up when being excessively tensioned.

As shown in FIGS. 1 to 4, in this embodiment, an end surface at a side, away from the elastic cover sheet 2, of the structural layer 1 is further provided with a sample inlet 16 in communication with the liquid storage cell 11, thus, when storing the liquid, a sample can be filled into the liquid storage cell 11 directly via the sample inlet 16, and then the sample inlet 16 is sealed by a single-sided adhesive tape or the like, to realize the feeding, sealing and storage of the liquid. With the sample inlet 16, the sample feeding operation can be performed after the elastic cover sheet 2 and the structural layer 1 are attached and sealed. For the chip having the second elastic cover sheet 6, the second elastic cover sheet 6 may be provided with a through hole at a position corresponding to the sample inlet 16, to facilitate the sample feeding.

Alternatively, before the elastic cover sheet 2 is attached to the structural layer 1, liquid is directly filled into the liquid storage cell 11 from the outside, and then the elastic cover sheet 2 is attached to the structural layer 1, to realize the sealing and storage of the liquid without requiring providing the sample inlet 16. Whether to provide the sample inlet 16 can be chosen according to the sample feeding manner.

In this embodiment, for facilitating observation of the liquid inside the chip, the structural layer 1 and/or the elastic cover sheet 2 is a transparent layer, that is, at least one of the structural layer 1 and the elastic layer 2 is a transparent layer.

In this embodiment, the material of the structural layer 1 may be any one or any combination of a high molecular polymer material, glass or metal. Specifically, the high molecular polymer material may be polymethylmethacrylate, polydimethylsiloxane, polystyrene, polycarbonate, polypropylene, polyethylene terephthalate, cyclic olefin copolymer, silica gel or the like.

In this embodiment, the elastic cover sheet 2 is an elastic layer composed of a high molecular polymer material or an elastic film structure composed of a metal film, and the elastic cover sheet 2 has a thickness ranging from 0.01 mm to 2 mm. The high molecular polymer material may be polydimethylsiloxane, polypropylene, polyethylene terephthalate, cyclic olefin copolymer, silica gel or the like.

Further, the elastic cover sheet 2 is a single-sided adhesive tape, and is adhesively attached to the top surface of the structural layer 1.

As shown in FIGS. 1 to 16, a liquid storage and release assembly is further provided according to an embodiment of the present application, which includes a tray 3 and the liquid storage and release chip as described in all of the above embodiments. The tray 3 is provided with a valve column 31, the valve column 31 is configured to be inserted into a valve opening 14 of the liquid storage and release chip in a sealed manner, and is capable of pushing up an elastic cover sheet 2 of the liquid storage and release chip from a position corresponding to the valve opening 14 to form a circulation gap 4. The number of the valve columns 31 on the tray 3 is equal to the number of the valve openings 14 in the chip, and the positions of the valve columns 31 are in a one-to-one correspondence with the positions of the valve openings 14 in the chip. The height of the valve column 31 is determined depending on an axial length of the valve opening 14 of the chip, whether the plunger 5 is provided, and whether the through groove 17 is provided, and is not specifically limited here, as long as the valve column 31 can push up the portion, corresponding to the valve opening 14, of the elastic cover sheet 2 to form the circulation gap 4. When releasing the liquid, the chip is placed on the tray 3 with its valve opening 14 aligned with the valve column 31, and a centrifugal operation is performed along with the rotation of the tray 3.

The liquid storage and release assembly has a simple structure, a small volume, and can realize the liquid storage and release operation easily and reliably, and thus facilitating integration and portable operation.

The above embodiments are described in a progressive manner. Each of the embodiments is mainly focused on describing its differences from other embodiments, and references may be made among these embodiments with respect to the same or similar portions among these embodiments.

Based on the above description of the disclosed embodiments, the person skilled in the art is capable of carrying out or using the present application. It is obvious for the person skilled in the art to make many modifications to these embodiments. The general principle defined herein may be applied to other embodiments without departing from the spirit or scope of the present application. Therefore, the present application is not limited to the embodiments illustrated herein, but should be defined by the broadest scope consistent with the principle and novel features disclosed herein.

The invention claimed is:

1. A liquid storage and release assembly, comprising:

a tray provided with a valve column, and a liquid storage and release chip positioned above the tray, comprising:

a structural layer, wherein an end surface of a first side of the structural layer is provided with a liquid storage cell and a liquid quantitation cell, the liquid storage cell and the liquid quantitation cell are separated by a common partition wall, and the partition wall is provided with an opening passing through end surfaces of two opposite sides of the structural layer, and the two opposite sides of the structural layer comprises the first side and a second side; and an elastic cover sheet attached to the end surface of the first side of the structural layer and covering the liquid storage cell, the liquid quantitation cell and the opening in a sealed manner, wherein, in a closed position, the valve column does not extend into the opening of the liquid storage and release chip such that the elastic cover sheet seals the liquid storage cell and the liquid quantitation cell from communicating with each other, and in an open position, the valve column is pushed upward from its bottom so as to extend into the opening of the liquid storage and release chip and push up the elastic cover sheet of the liquid storage and release chip at a position of the opening, to form a circulation gap; and wherein the liquid storage cell and the liquid quantitation cell are in communication with each other through the circulation gap when the valve column is in the open position.

2. The liquid storage and release assembly according to claim 1, wherein the structural layer is further provided with a centrifugal positioning hole, and the liquid storage cell is located between the liquid quantitation cell and the centrifugal positioning hole.

3. The liquid storage and release assembly according to claim 1, wherein a surface, attached to the elastic cover sheet, of the partition wall is provided with a through groove, and the through groove is configured to allow the liquid storage cell, the liquid quantitation cell and the opening to be in communication with each other, and the elastic cover sheet is elastically attached to a surface of the through groove.

4. The liquid storage and release assembly according to claim 3, wherein the through groove has an arc-shaped cross section.

5. The liquid storage and release assembly according to claim 1, wherein the liquid storage and release chip further comprises a plunger filled in the opening in a sealed manner, wherein the plunger has a length less than a length of the opening.

6. The liquid storage and release assembly according to claim 1, wherein the liquid storage and release chip further comprises a second elastic cover sheet, wherein the second elastic cover sheet is attached to an end surface of the second side, away from the elastic cover sheet, of the structural layer, and the second elastic cover sheet covers the opening.

7. The liquid storage and release assembly according to claim 6, wherein a material of the second elastic cover sheet is silica gel, latex or polyurethane.

8. The liquid storage and release assembly according to claim 6, wherein an area of a section, at an end toward the elastic cover sheet, of the opening is smaller than an area of a section, at an end toward the second elastic cover sheet, of the opening.

9. The liquid storage and release assembly according to claim 1, wherein an end surface of the second side, away from the elastic cover sheet, of the structural layer is further provided with a sample inlet in communication with the liquid storage cell.

10. The liquid storage and release assembly according to claim 1, wherein the structural layer and/or the elastic cover sheet is a transparent layer.

11. The liquid storage and release assembly according to claim 1, wherein a material of the structural layer is any one or any combination of a high molecular weight polymer material, glass or metal.

12. The liquid storage and release assembly according to claim 1, wherein the elastic cover sheet is an elastic layer made of a high molecular weight polymer material, or an elastic film structure made of a metal film, and the elastic cover sheet has a thickness ranging from 0.01 mm to 2 mm.

13. The liquid storage and release assembly according to claim 1, wherein the elastic cover sheet is a single-sided adhesive tape.

14. The liquid storage and release assembly according to claim 2, wherein the liquid storage and release chip further comprises a second elastic cover sheet, wherein the second elastic cover sheet is attached to an end surface of the second side, away from the elastic cover sheet, of the structural layer, and the second elastic cover sheet covers the opening.

15. The liquid storage and release assembly according to claim 2, wherein an end surface of the second side, away from the elastic cover sheet, of the structural layer is further provided with a sample inlet in communication with the liquid storage cell.

16. The liquid storage and release assembly according to claim 3, wherein the liquid storage and release chip further comprises a second elastic cover sheet, wherein the second elastic cover sheet is attached to an end surface of the second side, away from the elastic cover sheet, of the structural layer, and the second elastic cover sheet covers the opening.

17. The liquid storage and release assembly according to claim 3, wherein an end surface of the second side, away from the elastic cover sheet, of the structural layer is further provided with a sample inlet in communication with the liquid storage cell.

18. The liquid storage and release assembly according to claim 4, wherein the liquid storage and release chip further comprises a second elastic cover sheet, wherein the second elastic cover sheet is attached to an end surface of the second side, away from the elastic cover sheet, of the structural layer, and the second elastic cover sheet covers the opening.

19. The liquid storage and release assembly according to claim 5, wherein the liquid storage and release chip further comprises a second elastic cover sheet, wherein the second elastic cover sheet is attached to an end surface of the second side, away from the elastic cover sheet, of the structural layer, and the second elastic cover sheet covers the opening.

* * * * *